US005263203A

United States Patent [19]

Kraemer et al.

[11] Patent Number: 5,263,203

[45] Date of Patent: Nov. 23, 1993

[54] INTEGRATED PUMP MECHANISM AND INFLATABLE LINER FOR PROTECTIVE

[75] Inventors: Nelson Kraemer, Mount Prospect; Ralph Infusino, Bloomingdale, both of Ill.

[73] Assignee: Riddell, Inc., Chicago, Ill.

[21] Appl. No.: 24,908

[22] Filed: Mar. 2, 1993

Related U.S. Application Data

[63] Continuation of Ser. No. 772,775, Oct. 7, 1991.

[51] Int. Cl.[5] ..... A42B 3/00

[52] U.S. Cl. ..... 2/413; 2/425; 2/DIG. 3

[58] Field of Search ..... 2/413, 410, 411, 424, 2/425, 6, DIG. 3, DIG. 10

[56] References Cited

U.S. PATENT DOCUMENTS

| | | | |
|---|---|---|---|
| 3,668,704 | 6/1972 | Conroy et al. | 2/413 |
| 3,787,893 | 1/1974 | Larcher | 2/187 X |
| 3,806,950 | 4/1974 | Spencer-Foote | 2/413 |
| 3,822,720 | 7/1974 | Souza | 137/846 |
| 3,866,243 | 2/1975 | Morgan | 2/413 X |
| 3,999,220 | 12/1976 | Keltner | 2/413 |
| 4,038,700 | 8/1977 | Gyory | 2/413 |
| 5,003,631 | 4/1991 | Richardson | 2/413 X |
| 5,014,366 | 5/1991 | Discipio, Sr. | 2/413 X |
| 5,083,320 | 1/1992 | Halstead | 2/413 |

*Primary Examiner*—Peter Nerbun

*Attorney, Agent, or Firm*—Hopgood, Calimafde, Kalil, Blaustein & Judlowe

[57] ABSTRACT

In accordance with one aspect of the present invention is a specific, illustrative embodiment of an integrated pump and inflatable liner assembly which comprises a hollow inflatable member for the reception and storage of fluid, the inflatable member having a selected configuration so as to line the protective headgear and partially encircle a user's head; the inflatable member housing at least one resilient member for protection of the user's head; and a pump formed integrally with the inflatable member for moving fluid therein. When the member is positioned inside a helmet, the pump is exposable for adjustment by the user. A bleed valve in the hollow member controls the passage of fluid from the hollow member.

11 Claims, 2 Drawing Sheets

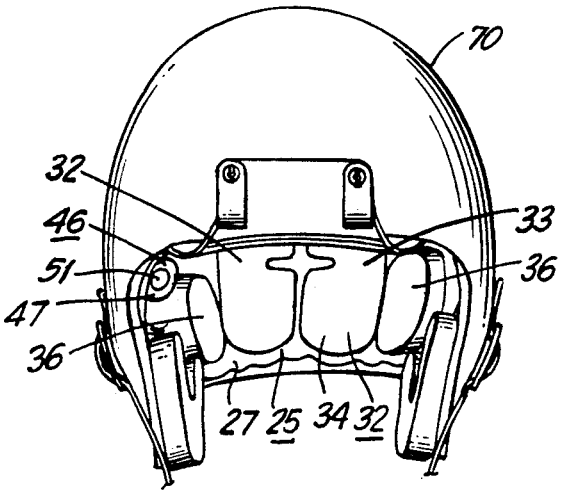
FIG.4
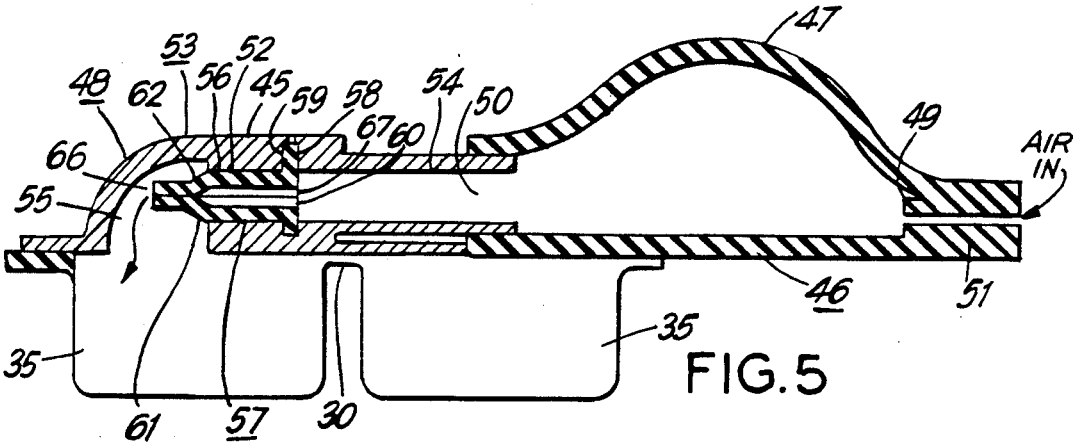
FIG.5
FIG.6
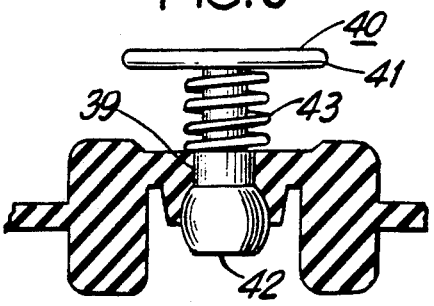
FIG.7
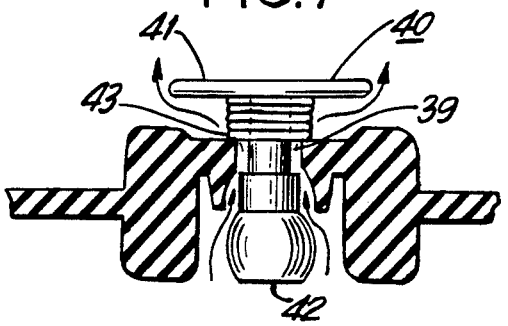

INTEGRATED PUMP MECHANISM AND INFLATABLE LINER FOR PROTECTIVE

This application is a continuation of application Ser. No. 07/772,775, filed Oct. 7, 1991.

BACKGROUND AND SUMMARY OF THE INVENTION

The invention relates to liners for protective headgear and, more specifically, to the integration of a pump mechanism with an inflatable liner assembly.

For protection of a user's head, it is necessary that protective headgear such as football helmets be properly sized and provide adequate support. To achieve this goal, various inflatable liners and padding configurations have been developed. Valves and pumps have also been developed to vary both the degree and distribution of liner inflation.

The inflatable liners have taken a number of forms. Some liners have an upper inflatable ring and a lower relatively larger inflatable ring connected to one another by an array of inflatable tubes so as to form a crown-like shape. A valve is positioned in one of the tubes for communication with a hole at the rear (or top) of the helmet shell. This valve arrangement permits access externally by a separate air-pump. Once the helmet has been positioned on the user's head, the pump is engaged with the valve, i.e., a needle at one end of the pump is inserted into the valve. The liner is then filled with air by operation of the pump.

Other inflatable liners utilize a pair of such crown-like units, one unit being sized to fit inside the other. The valve of the innermost unit faces the user's head, being accessible through the interior of the helmet shell only. Hence, to adjust the liner, the helmet must be removed from the user's head.

Still other inflatable liners comprise a strip of inflatable chambers positioned so as to extend from temple to temple about the sides and rear of the helmet shell. A flap extension hangs from the strip midsection for supporting the occipital protrusion of a user's head. A valve is positioned in the flap extension for communication with a hole at the rear of the helmet shell. An inflatable liner of this general configuration is shown, for example, in co-pending application Ser. No. 728,832, filed Jul. 9, 1991, entitled INFLATABLE LINER FOR PROTECTIVE HEADGEAR, disclosures of which are hereby incorporated by reference.

Because impact forces experienced during play may cause leakage of air from these valves, it may be desirable to add air to the liner during use. Also, if the user's head . expands, whether due to increased intensity of play or expansion of the user's head, loosening of the liner might be desireable to maintain comfort. In addition, because increased perspiration of the user's head may decrease friction between the liner and the head, tightening of the liner may also be desireable. Either way, for proper adjustment, the user must either carry around a portable pump or return to the "bench" during active play to obtain assistance in inflating the liner. This not only inconveniences the user, but also delays active play.

In addition, the imprecision associated with manual liner inflation often results in overinflation which decreases blood circulation about the user's head causing pain or discomfort. Excessive stress on the liner due to overinflation may also cause the liner to rupture.

Should underinflation or valve leakage occur, e.g., upon impact, the distribution of air inside the liner becomes unequal, causing the helmet to fit loosely upon the user's head. A poor fit may diminish the protective capability of the helmet.

Thus it is an object of the present invention to provide a practical, efficient, reliable and economical inflatable liner formed integrally with a pump mechanism for providing continuous adjustment of the headgear liner during use without sacrificing fit, comfort or durability.

The above and other objects of the present invention are realized in a specific, illustrative integrated pump and inflatable liner assembly which comprises a hollow inflatable member for the reception and storage of fluid, the inflatable member having a selected configuration so as to line the protective headgear and partially encircle a user's head; the inflatable member housing at least one resilient member for protection of the user's head; and a pump formed integrally with the inflatable member for moving fluid therein. When the member is positioned inside a helmet, the pump is exposable for adjustment by the user. A bleed valve in the hollow member controls the passage of fluid from the hollow member.

BRIEF DESCRIPTION OF THE DRAWINGS

The above and other features and advantages of the present invention are realized in a specific illustrative embodiment thereof, presented hereinbelow in conjunction with the accompanying drawings, in which:

FIG. 4 is a front view of the helmet shell of FIG. 2;

FIG. 5 is a side sectional view of the pump assembly of the present invention;

FIG. 6 is a side sectional view of a bleed valve of the present invention in a closed position; and FIG. 7 shows the bleed valve of FIG. 6 in an open position.

DETAILED DESCRIPTION OF THE PREFERRED EMBODIMENTS

Figure 1:
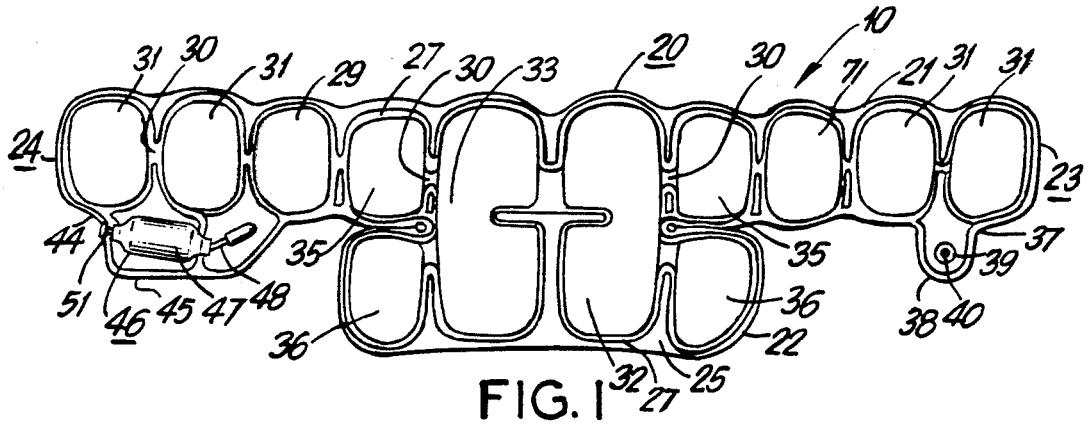
FIG. 1 is a plan view of an inflatable liner and pump assembly in accordance with one aspect of the present invention.

Referring now to the drawings and more particularly to FIG. 1, there is shown generally a combination adjustable pump mechanism and inflatable member or liner assembly 10 for protective headgear.

As shown in FIGS. 1–4, liner 20 comprises a hollow inflatable strip 21 and a hollow flap extension 22 located generally midway along and formed integrally with the strip, dividing the strip into left and right arms 23, 24, respectively. This permits a fluid, e.g., air, to flow freely throughout the liner interior.

Both strip 21 and flap extension 22 comprise a front sheet 25 and a rear sheet 26 (See FIG. 2) suitably joined along corresponding peripheral edges 27, e.g., using heat sealing or the like, such that a leakproof seal is formed. The front sheet has recessed portions 28 arranged in series throughout the surface thereof. Upon joining the front and rear sheets face to face and securing them along their peripheral edges, the recessed portions and corresponding rear sheet faces form a series of inflatable chambers 29 or chamber system throughout the surface of the strip.

Portions 30 between the chambers are left unsealed so as to form an interconnected network of passageways.

This network permits the distribution of fluid throughout the liner interior and, hence, inflation of chambers 29.

The strip preferably has more than one chamber, e.g., ten, along the length thereof, including eight outer 31 and two central strip chambers 32. It is also preferred that the flap extension have more than one chamber, e.g., four chambers, including two central flap chambers and two outer flap chambers.

Each pair of adjacent central chambers 32 of the strip and flap extensions are formed together into a rectangular-like eyeglass shape. Portion 33 of each central chamber so formed which corresponds with the nose bridge of the eyeglass shape is an internal passageway between central chambers of the flap extension and strip.

At least one resilient member 34, e.g., a polyurethane foam pad or the like, is suspended freely inside each chamber. Resilient members having shapes corresponding to those of eyeglasses are contained by the central chambers formed across the strip and flap extension.

Figure 2:
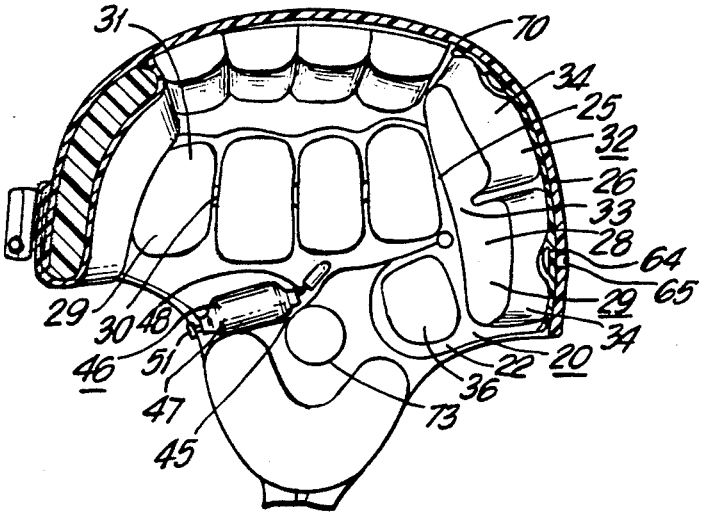
FIG. 2 is a side sectional view of a helmet shell showing the assembly of FIG. 1 in an operative position.

As best seen in FIG. 2, each resilient member occupies substantially the chamber interior, while permitting fluid to fill regions between the pad and chamber walls. By permitting pressurized fluid to occupy these regions, improved fit and comfort over conventional padding are achieved. The pads also add to the structural integrity of the liner assembly.

The outer chambers 31 of the strip are also connected to adjacent outer chambers 31, the innermost outer chambers 35 being interconnected with adjacent central chambers 32 at unsealed portions 30. This allows fluid to flow freely throughout the chamber system.

In flap extension 22, each of the two outer chambers 36 are unconnected to the strip at their outer boundaries, but are connected to the chamber system through the adjacent central chambers 32. Hence, each outer flap chamber 36 extends along side the strip and across from a corresponding innermost outer strip chamber 35.

Figure 3:
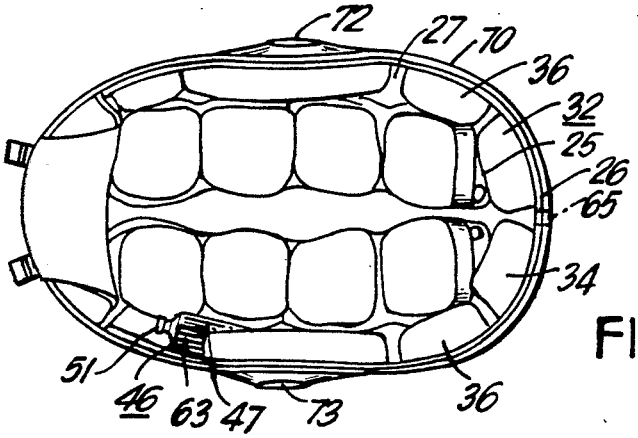
FIG. 3 is a bottom view of the helmet shell of FIG. 2.

The resulting chamber system permits fluid to flow freely throughout the chambers upon the introduction of fluid at any point in the system At lower edge 37 of strip left arm 23 is a bump flap extension 38. As shown in FIG. 1, bump flap extension 38 is located between the two outermost left arm strip chambers 31 for ready access by the user. The bump flap extension has a hole 39 for mounting a bleed valve 40, e.g., a spring loaded plunger 41 and plug 42 arrangement, as shown in FIGS. 6 and 7. Spring 43 normally maintains the plunger in a closed position (see FIG. 6). When the plunger is depressed by a user's finger, the spring is compressed and fluid is bled from the valve (and the chamber system), as shown by arrows in FIG. 7. When in place, the valve hangs proximate to a lower edge of the helmet for ready access by the user. In an alternative embodiment of the present invention, bump flap extension 38 is located below outer strip chamber 71. In this position (adjacent to the ear hole 72 as shown in FIGS. 1 and 3) the valve is readily accessible by the user through ear hole 72.

On lower edge 44 of strip right arm 23 is a longitudinal flap extension 45 which mounts pump mechanism 46. The pump mechanism comprises a pump 47, e.g., an air pump bulb. A tubular passageway 48 connects the pump to the longitudinal flap extension. The pump has openings 49 and 50 at opposing first and second ends, respectively, the first opening exhausting fluid from the pump and the second mounting a one-way intake valve 51. The intake valve permits the pump bulb to be filled with fluid after it has been squeezed and has released or exhaled fluid through the first end.

While the present invention has been described as using a pump bulb and bleed valve for affecting inflation and deflation, respectively, of the liner, it is understood that any means for moving fluid to and from the liner could be utilized, giving consideration to the purpose for which the present invention is intended.

The first end is connected to an end of passageway 48 by any suitable means, e.g., a leakproof seal. The other end of the passageway is secured to a control valve 52 formed integrally with the longitudinal flap extension. Suitable control valves include a duck-bill or other one-way control valve.

As shown in FIG. 5, control valve assembly 53 comprises a cylindrical horizontal passageway 54 with a cylindrical down turned elbow passageway 55 which leads to the chamber system. The horizontal passageway has a smaller diameter portion 56 generally midway along its length for receiving a duck-bill valve 57.

Duck-bill valve 57 comprises a flanged base 58 adjacent its inlet end 67. This base abuts a shoulder 59 where the passageway changes to the smaller diameter. The valve has a cylindrical body adapted to fit snugly in the passageway. Walls 61, 62 of the valve piece taper and meet adjacent an outlet end 66 thereof.

When fluid enters from valve inlet 60, the pressure of fluid flow forces open the tapered walls 61, 62, permitting the fluid to enter chambers 35. When fluid flow ceases, however, the summation of forces due to the external fluid pressure from the chamber system plus the elastic memory of the tapered walls force the walls into a closed position, thereby preventing backflow of fluid through the valve and into the chamber system.

Longitudinal flap extension 45 also mounts suitable fasteners for releasably securing the pump to the flap extension during play. For example, cooperating Velcro® strips 63 are placed on the pump and longitudinal flap extension so that the pump may be secured to the flap extension during helmet use. When adjustment of the liner assembly is desired, the pump is readily detached from the flap extension such that it hangs below a lower edge of the helmet. This permits the user to grasp and operate the pump.

Alternatively, the pump may be operated while attached to the liner by simply placing one finger inside the helmet between the pump bulb and the user's head. The user then simply presses the pump bulb against the inside of the helmet. Alternatively or in conjunction with the present embodiment, the pump is detachably secured vertically to the helmet, using suitable fasteners, e.g., Velcro® strips. In this orientation, the pump may be operated while attached to the liner by inserting the user's finger through ear hole 73 and pressing the pump bulb against the user's head (Note FIG. 2 which illustrates pump 47 adjacent to ear hole 73).

To mount the liner assembly into helmet shell 70, suitable fasteners, e.g., Velcro® strips, are arranged about the outward face of the rear sheet, preferably adjacent the outermost outer strip and flap extension chambers. Cooperating fasteners may also be mounted at desired locations about the helmet interior.

The liner assembly is then placed inside the helmet shell. Corresponding fasteners are aligned and engaged with one another so that the pump mechanism is adjacent the right temporal portion of the helmet shell and the bleed valve is proximate the left temporal portion of the shell, each being preferably accessible through a corresponding ear hole.

On the outside of rear sheet 26 is a centrally located plug 64 for engaging a hole 65 in the rear of the helmet shell. Upon engagement, the plug facilitates the desired positioning and securement of liner assembly 20 in the helmet shell.

Flap extension 22 preferably hangs downward at the rear of the helmet shell, the central strip and flap extension chambers abutting the occipital protrusion and other rear portions of the user's skull.

The liner is positioned so that it extends from the right-hand outer edge of the user's forehead, across the user's right temple, around the rear of the user's head and then, in the same manner, back around to the left-hand outer edge of the user's forehead. When positioned in this manner, it has been found that optimum fit is provided to the user's head with minimal discomfort.

To inflate the liner assembly, first the user places the helmet shell on his or her head. In accordance with one embodiment of the present invention, the user then simply grasps the pump in his or her hand, tears it from the cooperating fastener, e.g., a Velcro® strip, and repeatedly squeezes and releases the same until the desired degree of liner inflation has been achieved. An inflation pressure is generally selected which allows the helmet to remain comfortably, but securely, on the user's head while minimizing the effects of blows to the head, for example, those normally experienced during athletic play. When adjustment has been completed, the pump bulb is reattached to the longitudinal flap extension.

To adjust or deflate the liner assembly, the user simply depresses the bleed valve by pressing the plunger inward until a selected volume of fluid has been discharged from the liner and the desired comfort is achieved.

The present invention is advantageous in providing a novel inflatable apparatus for protecting a user's head, while maintaining a secure but comfortable fit. The integration of a pump mechanism with an inflatable liner for protective headgear advantageously permits the user to adjust the liner for fit and comfort during play, without inconvenience or delay.

The above-described arrangement and methodology is merely illustrative of the principles of the present invention. Numerous modifications and adaptations thereof will be readily apparent to those skilled in the art without departing from the spirit and scope of the present invention. For example, although the present invention has been shown and described for use with a football helmet, it is understood that this invention could be modified to accommodate any type of protective or nonprotective headgear as well as other functions consistent with the objectives of the present invention.

What is claimed is:

1. An inflatable liner for protective headgear, the liner comprising a hollow member for the reception and storage of fluid, the member having a configuration for lining the protective headgear and partially encircling a user's head, and housing at least one resilient member so as to protect the user's head; means detachable secured to the headgear interior for moving fluid into the member, the moving means being formed integrally with the member and being positioned adjacent to a first hole in the headgear such that the moving means is accessible to the user through the first hole, the first hole being proximate to an ear of the user; and means for controlling the passage of fluid from the hollow member, the control means being formed integrally with the member and being positioned adjacent to a second hole in the headgear such that the control means is accessible to the user through the second hole, the second hole being proximate to an ear of the user.

2. The inflatable liner set forth in claim 1 wherein the hollow member has inflatable chambers each for receiving a resilient member.

3. The inflatable liner set forth in claim 2 wherein the hollow member comprises a hollow strip configured for partially encircling the user's head.

4. The inflatable liner set forth in claim 3 wherein the hollow member further comprises a hollow flap extension formed integrally with the strip so as to permit the flow of fluid therebetween.

5. The inflatable liner set forth in claim 2 wherein the resilient member comprises a polyurethane foam pad.

6. The inflatable liner set forth in claim 1 wherein the moving means comprises a pump for inflating the liner with fluid.

7. The inflatable liner set forth in claim 2 further comprising means for maintaining uniform inflation of the member.

8. The inflatable liner set forth in claim 7 wherein the hollow member comprises a recessed front sheet connected to a rear sheet so as to form the inflatable chambers.

9. The inflatable liner set forth in claim 8 wherein the maintaining means includes passageways between the inflatable chambers for permitting flow equalization throughout the hollow member interior.

10. A protective headpiece which comprises:

a headpiece shell having a hold proximate to one ear of a user, a protective liner positioned inside the shell, the liner comprising a hollow member for the reception and storage of fluid, the member having a configuration so as to line the shell and partially encircle the user's head, means formed integrally with the liner for moving fluid into the member, the moving means including a pump detachable secured to the shell interior for inflating the liner with fluid, at least one member in the hollow member for protection of the user's head, and means for controlling the passage of fluid from the hollow member, the control means being positioned adjacent to the hole such that the control means is accessible to the user through the hole.

11. A protective headpiece which comprises:

a headpiece shell having a hole proximate to each ear of a user, a protective liner positioned inside the shell, the liner comprising a hollow member for the reception and storage of fluid, the member having a configuration so as to line the shell and partially encircle the user's head, means formed integrally with the liner for moving fluid into the member, the moving means including a pump detachably secured to the shell interior for inflating the liner with fluid, the pump being accessible to the user through one of the holes in the headpiece shell, at least one member in the hollow member for protection of the user's head, and means for controlling the passage of fluid from the hollow member, the control means being positioned adjacent to one of the holes such that the control means is accessible to the user through that hole.

* * * * *

UNITED STATES PATENT AND TRADEMARK OFFICE

CERTIFICATE OF CORRECTION

PATENT NO. : 5,263,203

DATED : November 23, 1993

INVENTOR(S) : Nelson Kraemer and Ralph Infusino

It is certified that error appears in the above-identified patent and that said Letters Patent is hereby corrected as shown below:

On the title page, item (54) and column 1 lines 1-2 should read:

--INTEGRATED PUMP MECHANISM AND INFLATABLE LINER FOR PROTECTIVE HEADGEAR--

Column 1, line 59, the word "proper" is incorrect
it should read: --desirable--

Column 5, line 61 and column 6, line 40, the word "detachable" is incorrect
it should read: --detachably--

Column 6, line 31, the word "hold" is incorrect
it should read: --hole--

Signed and Sealed this

Seventh Day of June, 1994

Bruce Lehman

*Attest:*

BRUCE LEHMAN

*Attesting Officer*

*Commissioner of Patents and Trademarks*